US005655315A

United States Patent [19]

Mershon

[11] Patent Number: 5,655,315

[45] Date of Patent: Aug. 12, 1997

[54] SHOE WITH INFLATABLE HEIGHT-ADJUSTMENT CUSHION

[76] Inventor: Randolph J. Mershon, 300 Winston Dr., Cliffside Park, N.J. 07010

[21] Appl. No.: 696,375

[22] Filed: Aug. 13, 1996

[51] Int. Cl.[6] ..... A43B 13/20; A43B 21/28; A43B 7/38

[52] U.S. Cl. ..... 36/97; 36/29; 36/35 B

[58] Field of Search ..... 36/29, 35 B, 35 R, 36/37, 28, 3 R, 3 B

[56] References Cited

U.S. PATENT DOCUMENTS

| | | | |
|---|---|---|---|
| 4,462,171 | 7/1984 | Whispell | 36/3 B |
| 4,610,099 | 9/1986 | Signori | 36/29 |
| 4,856,208 | 8/1989 | Zaccaro | 36/29 |
| 4,887,367 | 12/1989 | Mackness et al. | 36/35 B |
| 4,991,317 | 2/1991 | Lakic | 36/44 |
| 4,999,932 | 3/1991 | Grim | 36/29 |
| 5,025,575 | 6/1991 | Lakic | 36/44 |
| 5,222,312 | 6/1993 | Doyle | 36/28 |
| 5,295,314 | 3/1994 | Moumdjian | 36/29 |
| 5,353,459 | 10/1994 | Potter et al. | 12/146 R |
| 5,353,525 | 10/1994 | Grim | 36/29 |
| 5,363,570 | 11/1994 | Allen et al. | 36/38 |
| 5,443,529 | 8/1995 | Phillips | 36/29 |

FOREIGN PATENT DOCUMENTS

| | | | |
|---|---|---|---|
| PCT/EP89/00299 | 11/1989 | European Pat. Off. | 36/29 |
| 721492 | 3/1932 | France | 36/29 |
| 87 14204 | 4/1989 | France | 36/29 |
| 7507 | 6/1893 | United Kingdom | 36/39 |

*Primary Examiner*—Paul T. Sewell
*Assistant Examiner*—Anthony Stashick
*Attorney, Agent, or Firm*—Cesari and McKenna

[57] ABSTRACT

A cushioned, height-adjustable shoe has a hollow for receiving a wearer's foot, the hollow defined by a base on which the wearer's foot rests and an enclosure surrounding at least a portion of the wearer's foot; and within the hollow, an inflatable bladder associated with the base for lifting the wearer's foot to a degree determined by the amount of inflation. The bladder has a collapsable wall that may include pleats. In one embodiment, the bladder is wedge-shaped with a maximum height along the rear (heel) segment, and is disposed between the sole of the shoe and a soft but relatively thin foot pad so as to be invisible during use. In a second embodiment, the bladder constitutes the sole of the shoe, and once again is is defined peripherally by a set of expandable pleats. The bladder is accessed for inflation by means of a pump located beneath the shoe pad.

9 Claims, 2 Drawing Sheets

SHOE WITH INFLATABLE HEIGHT-ADJUSTMENT CUSHION

BACKGROUND OF THE INVENTION

1. Field of the Invention

The present invention relates generally to footwear, and specifically to shoes having undetectable means allowing the wearer to alter his or her apparent height.

2. Description of the Related Art

Manufacturers of various kinds of shoes have recently begun to introduce air pockets into shoe bodies as a means of providing comfort, resilience or performance. Generally located within the sole of the shoe, these pockets can take various forms, ranging from simple dispersed air bubbles to inflatable chambers or cells. In athletic shoes, for example, such chambers provide both a cushioning function and increased springiness.

Some of these arrangements can be quite elaborate. For example, U.S. Pat. No. 5,222,312 describes a shoe having a series of hollow chambers within the sole of the shoe, a separate air cell within each hollow chamber, and a pneumatic pump assembly including a series of tubes that feed each chamber.

One function not provided by current designs is control of the wearer's apparent height. The air cells, although deformable, are suspended within a surrounding structure of largely fixed dimension. Accordingly, even full inflation of cells that receive air via a pump does not alter the overall contour or volume of the shoe; the wearer's apparent height, therefore, is unaffected by inflation.

Shoes designed expressly for this purpose, by contrast, rely on various forms of rigid structural members embedded within the shoe to lift parts of the wearer's foot. For example, the portion of the shoe above the heel can be tapered upward, lifting the wearer's foot in a manner that augments apparent height. These shoes are frequently uncomfortable in that the wearer's weight is concentrated toward the toe along a hard surface. They also provide only a fixed amount of height adjustment.

DESCRIPTION OF THE INVENTION

Brief Summary of the Invention

The present invention increases comfort through the provision of an adjustably inflatable cushion upon which the wearer's foot rests, while also providing the option of increasing apparent height. In other words, the cushioning effect provided by the invention can be adjusted for its own sake, relieving stress and reducing shock on the wearer's feet. Since inflation also raises the wearer's foot or portion thereof, however, it can be used to controllably augment height. The optimal balance between comfort and height augmentation is fully within the control of the wearer.

In one embodiment, the invention comprises a shoe having a hollow for receiving a wearer's foot, the hollow defined by a base on which the wearer's foot rests and an enclosure surrounding at least a portion of the wearer's foot; and within the hollow, an inflatable bladder associated with the base for lifting the wearer's foot to a degree determined by the amount of inflation. In preferred embodiments, the inflatable bladder is wedge-shaped and occupies the rear portion of the shoe (i.e., extending from the back of the heel to a point not more than halfway between the back of the heel and the front of the toe). The shoe enclosure may be a wall with laces and a tongue that surrounds the wearer's foot up to the ankle, or higher in the case of a boot.

The bladder, if wedge-shaped, has a collapsable wall spanning opposed top and bottom walls, which are joined at a seam at the forward end of the bladder. The wall widens from the seam, reaching a maximum height at the end of the bladder opposed to the seam, which is generally rounded to conform to the heel of the shoe; the wall may be pleated to facilitate reliable and durable expansion and contraction. The bladder is preferably disposed between the sole of the shoe and a soft but relatively thin foot pad, of the type commonly employed in ordinary shoes, that further cushions the wearer's foot and prevents direct contact with the bladder seam.

To inflate the bladder, the wearer operates a pneumatic pump located for convenient access but hidden from view. Preferably, the pump is located on the inner face of the heel (which faces forward toward the toe of the shoe), and an air passage extends from the pump to the bladder through the heel. The pump comprises a one-way check valve that admits air into the bladder but prevents its escape. In this manner, the wearer is free to determine amount of inflation, which will persist during use of the shoe. Opening the valve and applying light pressure to the bladder evacuates any air previously introduced therein.

In a second embodiment, the bladder constitutes the sole of the shoe, and is defined peripherally by a set of expandable pleats. The bladder is accessed for inflation by means of a pump located beneath the shoe pad.

BRIEF DESCRIPTION OF THE DRAWINGS

The foregoing discussion will be understood more readily from the following detailed description of the invention, when taken in conjunction with the accompanying drawings, in which.

DETAILED DESCRIPTION OF THE PREFERRED EMBODIMENTS

Figure 1:
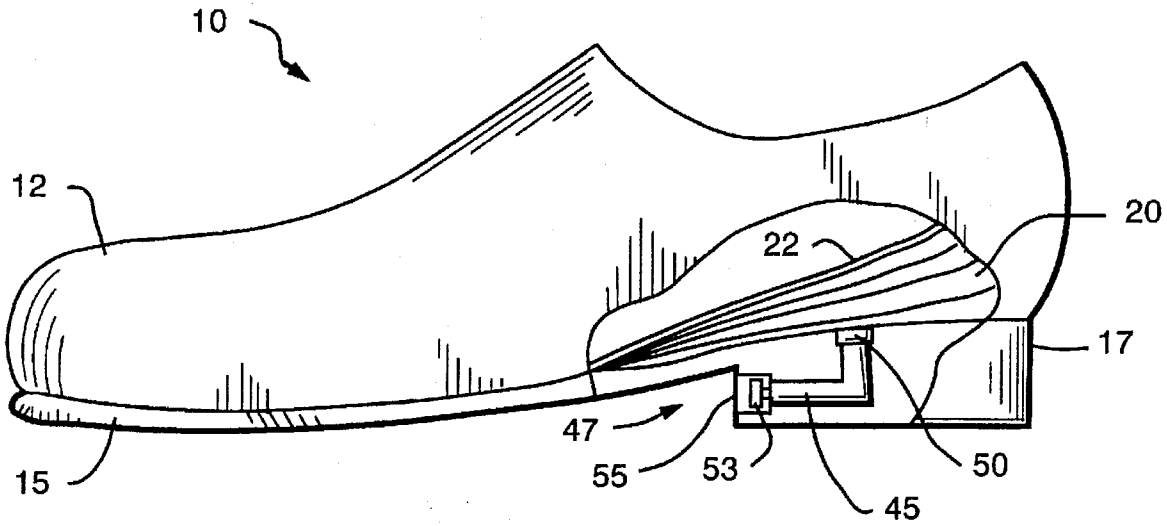
FIG. 1 is a side elevation of the first embodiment of the invention with parts cut away.

Refer first to FIG. 1, which shows a shoe in accordance with the first embodiment of the invention, indicated generally at 10. The shoe 10 includes an enclosure 12, which may be continuous, smooth in contour and unlaced, as shown in the drawing, or may include a tongue and laces; the body may also rise beyond the wearer's ankle to define a boot. The invention, in short, is not limited to to any particular type of shoe.

Enclosure 12 is affixed in a conventional manner to a shoe sole 15, which may be made of leather, rubber or other durable material. Depending from the sole at the rear of shoe 10 is a heel 17. Within the hollow defined by enclosure 12 and sole 15 is an inflatable, wedge-shaped bladder 20, shown more comprehensively in FIG. 2. A nylon or fabric shoe pad 22 is glued or otherwise affixed to the interior face of sole 15 and the upper wall of bladder 20; the lower wall of bladder 20 is likewise affixed to the interior face of sole 15. Bladder 20 is preferably fabricated from a tough, durable, but flexible material such as rubber or heavy plastic.

Figure 2:
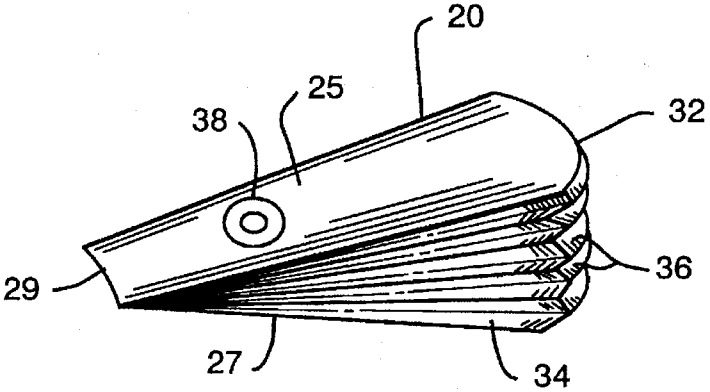
FIG. 2 is an isometric view of a preferred form of bladder for use with the first embodiment.

Refer now to FIG. 2, which illustrates bladder 20 in greater detail. Bladder 20 contains first and second opposed, identically shaped flat faces 25, 27 (face 25 actually being the bottom face) joined at one end in a seam 29. At the other end 32, the faces are rounded to conform to the rear (heel) portion of shoe 10. A collapsable side wall 34 joins faces 25, 27 around their peripheries from one end of seam 29 to the other. In the illustrated version, side wall 34 has a series of accordian pleats 36, which may be reinforced for strength. While pleats 36 are desirable to ensure reliable and durable expansion and contraction, they are not necessary; a simple membrane will suffice. Bottom face 25 includes a fluid coupling 38, which facilitates introduction and evacuation of a fluid, preferably air, to and from bladder 20.

The manner in which this occurs can be appreciated with renewed reference to FIG. 1. An air passage 45 extends from the inner face 47 of heel 17 to the interior face of sole 15, terminating in a fluid coupling 50 complementary to coupling 38 on bladder 20. Although it is preferred to have the exteriors of faces 25, 27 glued or otherwise affixed to abutting surfaces, this is not strictly necessary; bladder 20 can be made removable by leaving these surfaces unaffixed, and relying on mating between couplings 38, 50 as an anchor.

Figure 3:
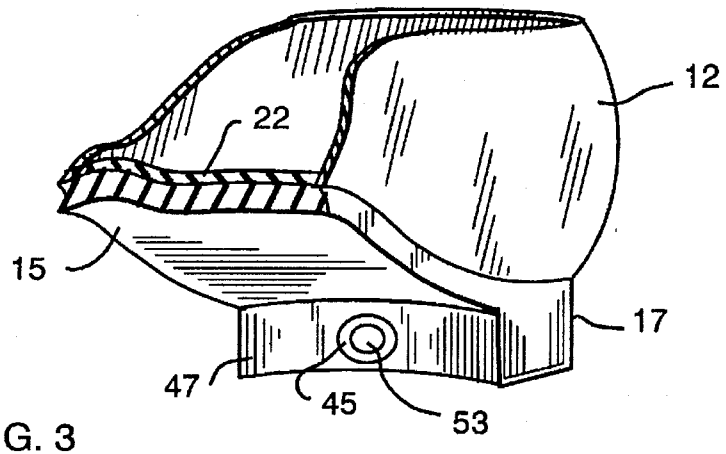
FIG. 3 is a partial isometric view of the embodiment shown in FIG. 1.

An inflation pump 53 is located at the other end of fluid passage 45, preferably within a recess 55. As shown in FIG. 3, this arrangement hides pump 53 during normal use. Pump 53 comprises a finger-operated plunger and a one-way check valve that prevents the escape of air introduced by the action of the plunger. In use, the wearer first uses pump 53 to inflate bladder 20 to a desired extent. The check valve of pump 53 prevents the air from escaping during use of the shoe. If the wearer desires to reduce the lift provided by bladder 20, or to wear shoe 10 without any cushioning, the wearer exerts light pressure against bladder 20 with the check valve open (i.e., with the plunger of pump 53 pressed in). This operation is conveniently performed while the wearer is actually wearing the shoe 10: the wearer simply grasps shoe 10 under heel 17, pressing the plunger of pump 53 with his finger while urging shoe 10 against his palm.

Figure 4:
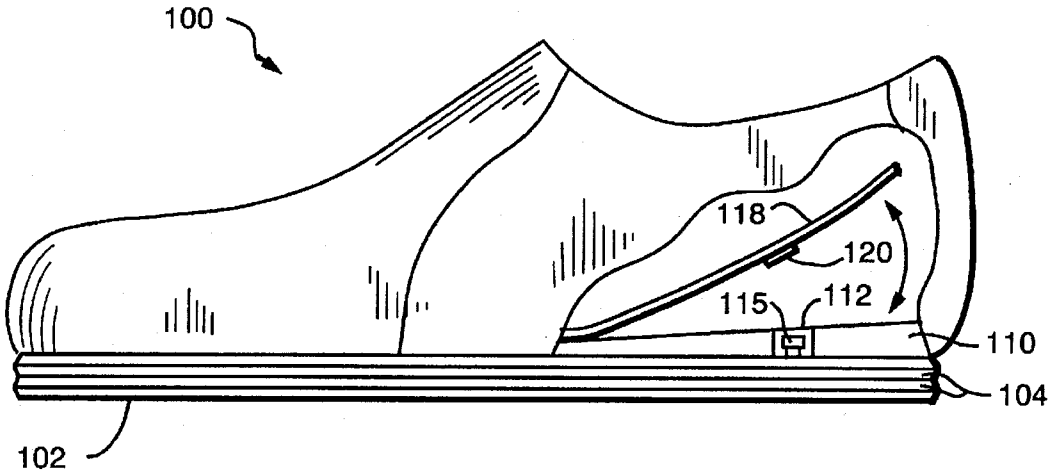
FIG. 4 is a side elevation of the second embodiment of the invention with parts cut away.

Refer now to FIG. 4, which illustrates the second embodiment of the invention. In this case, a bladder 102 forms the entire sole of the shoe, indicated generally at 100. Once again, bladder 102 preferaby includes a series of pleats 104, which, if they are exterior to the shoe 100, may be much narrower, and allow less expansion, than the pleats 36 of the previously described embodiment. Alternatively, pleats 104 can be hidden behind a flexible wall, or can be omitted entirely in favor of such a wall.

A rigid or semi-rigid floor 110 of shoe 100 rises toward the rear (heel) to define a hollow 112, which contains a finger-operated pump 115 similar in concept and design to pump 53. Pump 115 is fluidly coupled to bladder 102 and is operated by the wearer in the manner previously described to inflate and deflate bladder 20. A shoe pad 118 overlies the interior face of floor 110, and contains a rigid disk 120 conforming to the shape of hollow 112 so that in use, with pad 118 in place, the existence of hollow 112 is not noticeable to the wearer.

Figure 5:
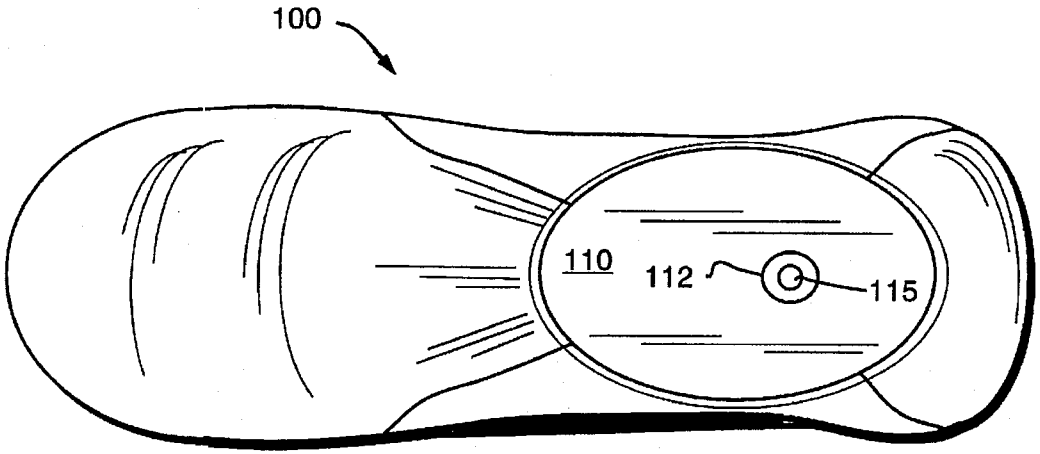
FIG. 5 is a plan view of the embodiment shown in FIG. 4 showing the location of the bladder-inflation device.

As shown in FIG. 5, which illustrates shoe 100 with pad 118 removed, hollow 112 may be round in dimension and is conveniently accessible. In a variation to this embodiment, the bladder may constitute a part of the sole rather than its entirety. For example, women's shoes may be designed with soles that rise toward the rear of the shoe without defining a separate heelpiece; bladder 102 can replace this built-up portion of the sole, joining the conventional flat portion that extends toward the front of the shoe.

It will therefore be seen that the objectives of comfort and height adjustment are independently and efficiently obtained, since only a slight elevation is typically necessary to afford a "cushion of air" experience when walking. The terms and expressions employed herein are used as terms of description and not of limitation, and there is no intention, in the use of such terms and expressions, of excluding any equivalents of the features shown and described or portions thereof, but it is recognized that various modifications are possible within the scope of the invention claimed.

What is claimed is:

1. A shoe for facilitating height adjustment, the shoe comprising:

a. means defining a hollow for receiving a wearer's foot, said means comprising a base portion on which the wearer's foot rests and an enclosure surrounding at least a portion of the wearer's foot;

b. an inflatable wedge-shaped bladder that is (i) disposed within the hollow, (ii) associated with the base, and (iii) configured for volumetric expansion to facilitate lifting of the wearer's heel to a predetermined extent, the extent depending on the amount of inflation.

2. The shoe of claim 1 wherein the base portion terminates in a rounded end, the inflatable means comprising upper and lower flat members disposed one above the other and joined at a forward seam, the flat members having a rear portion opposed to the seam and conforming to the rounded end.

3. The shoe of claim 2 wherein the inflation means comprises a collapsable wall extending from the seam around the upper and lower members and joining said members, the collapsable wall increasing in height from the seam and reaching a maximum height opposite the seam.

4. The shoe of claim 3 wherein the wall is pleated.

5. The shoe of claim 1 further comprising user-accessible inflation-control means for inflating and deflating the inflatable means.

6. The shoe of claim 5 wherein the base portion comprises forward and rear regions and further comprising:

a. a heel projecting from beneath the rear region of the base portion, the heel comprising a bottom surface and, perpendicular to the bottom surface and facing the forward end of the base portion, an inner heel face; and b. an air passage extending from the inner heel face to the rear region of the base portion and including means for forming an airtight fluid coupling to the inflatable means, the inflation-control means being disposed within the heel and configured to selectably force air through the air passage and into the inflatable means, and to allow air to escape from the inflatable means through the air passage.

7. The shoe of claim 6 wherein the inflation-control means comprises an air pump recessed within the heel.

8. The shoe of claim 5 further comprising a removable foot pad disposed above the base portion and above the inflatable means therein, the inflatable means being removably coupled via an air passage to the inflation-control means.

9. The shoe of claim 1 wherein the base portion comprises forward and rear regions, the rear region terminating in the rounded end, the bladder conforming to the rear region.

* * * * *